US011545736B2

(12) United States Patent
Li et al.

(10) Patent No.: US 11,545,736 B2
(45) Date of Patent: Jan. 3, 2023

(54) BASE STATION ANTENNA

(71) Applicant: CommScope Technologies LLC, Hickory, NC (US)

(72) Inventors: YueMin Li, Suzhou (CN); Jian Zhang, Suzhou (CN); Bo Wu, Suzhou (CN); Ligang Wu, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 62 days.

(21) Appl. No.: 17/324,171

(22) Filed: May 19, 2021

(65) Prior Publication Data

US 2021/0376455 A1 Dec. 2, 2021

(30) Foreign Application Priority Data

May 29, 2020 (CN) ..... 202020943827.7

(51) Int. Cl.
*H01Q 1/24* (2006.01)
*H01Q 5/50* (2015.01)
(Continued)

(52) U.S. Cl.
CPC ..... *H01Q 1/246* (2013.01); *H01Q 5/42* (2015.01); *H01Q 5/50* (2015.01); *H01Q 15/24* (2013.01);
(Continued)

(58) Field of Classification Search
CPC ..... H01Q 1/246; H01Q 1/38; H01Q 21/0006; H01Q 25/005; H01Q 19/108; H01Q 21/30;
(Continued)

(56) References Cited

U.S. PATENT DOCUMENTS 6,208,299 B1 * 3/2001 Lindmark ..... H01Q 21/30 343/700 MS
8,633,862 B2 * 1/2014 Tasaki ..... H01Q 1/246 343/893
(Continued)

FOREIGN PATENT DOCUMENTS

WO 2021003030 A1 1/2021

OTHER PUBLICATIONS

Notification of Transmittal of the International Search Report and the Written Opinion of the International Searching Authority, or the Declaration, for corresponding application PCT/US2021/033101, dated Sep. 8, 2021, 13 pages.

*Primary Examiner* — Vibol Tan
(74) *Attorney, Agent, or Firm* — Myers Bigel, P.A.

(57) ABSTRACT

A base station antenna includes a column of radiating elements comprising first and second sets of radiating elements, each radiating element being configured to operate in a first frequency band that has first and second sub-bands. The second set of radiating elements is located above and/or below the first set of radiating elements. The antenna further includes a feeding assembly that is configured to feed first RF signals that are in the first sub-band and second RF signals that are in the second sub-band to the column of radiating elements, where the feeding assembly is configured to partially attenuate sub-components of the second RF signals that are fed to the second set of radiating elements more than sub-components of the first RF signals that are fed to the second set of radiating elements.

15 Claims, 10 Drawing Sheets

(51) Int. Cl.

| | |
|---|---|
| ***H01Q 21/00*** | (2006.01) |
| ***H01Q 15/24*** | (2006.01) |
| ***H01Q 21/28*** | (2006.01) |
| ***H01Q 21/26*** | (2006.01) |
| ***H01Q 21/08*** | (2006.01) |
| ***H01Q 5/42*** | (2015.01) |

(52) U.S. Cl.
CPC ..... *H01Q 21/08* (2013.01); *H01Q 21/26* (2013.01); *H01Q 21/28* (2013.01)

(58) Field of Classification Search
CPC ..... H01Q 9/0414; H01Q 21/24; H01Q 19/32; H01Q 5/48; H01Q 21/0075; H01Q 21/28; H01Q 25/00; H01Q 5/42; H01Q 21/065; H01Q 1/24; H01Q 21/26; H01Q 1/2275; H01Q 19/10; H01Q 21/08; H01Q 21/064; H01Q 21/061; H01Q 21/00; H01Q 15/0086; H01Q 1/243; H01Q 1/288; H01Q 13/00; H01Q 3/267; H01Q 3/24; H04B 7/0617; H04B 1/0475
See application file for complete search history.

(56) References Cited

U.S. PATENT DOCUMENTS

| | | | | |
|---|---|---|---|---|
| 2010/0127949 | A1* | 5/2010 | Shimizu ..... | H01Q 21/08 343/893 |
| 2015/0200467 | A1 | 7/2015 | Kurk et al. | |
| 2015/0357721 | A1 | 12/2015 | Zimmerman et al. | |
| 2018/0026380 | A1 | 1/2018 | Powell | |
| 2018/0159215 | A1 | 6/2018 | Suzuki et al. | |

* cited by examiner

BASE STATION ANTENNA

CROSS-REFERENCE TO RELATED APPLICATION

The present application claims priority to Chinese Patent Application No. 202020943827.7, filed May 29, 2020, the entire content of which is incorporated herein by reference as if set forth fully herein.

FIELD

The present disclosure relates to a cellular communication system, and more specifically, to a base station antenna.

BACKGROUND

In a typical cellular communication system, a geographic area is divided into a series of regions that are referred to as "cells", and each cell is served by one or more base stations. The base station may include baseband equipment, radio devices, and base station antennas, where the antennas are configured to provide two-way radio frequency (RF) communications with stationary and mobile subscribers (or may be referred to as users) geographically located within the cell. In many cases, a cell can be divided into a plurality of sectors, and each individual antenna provides coverage for each sector. The base station antennas are usually mounted on a tower structure or other raised structures, and outwardly directed radiation beams (also referred to as antenna beams) generated by each base station antenna serve the corresponding sectors. A base station may operate in a single frequency band, or may alternatively be a "multi-band" base station that supports communication in a plurality of cellular frequency bands.

FIG. 1 is a schematic diagram of a conventional base station 10. As shown in FIG. 1, the base station antenna 10 includes an antenna 20 that can be mounted on a raised structure 30. In the illustrated embodiment, the raised structure 30 is a small antenna tower. However, it should be understood that a variety of mounting locations, including, for example, a telegraph pole, a building, a water tower, etc., may be used. As further shown in FIG. 1, the base station 10 also includes base station devices such as a baseband unit 40 and a radio device 42. In order to simplify the drawing, a single baseband unit 40 and a single radio device 42 are shown in FIG. 1. However, it should be understood that more than one baseband unit 40 and/or radio device 42 may be provided. In addition, although the radio device 42 is shown as being co-located with the baseband unit 40 at the bottom of the raised structure 30, it should be understood that in other cases, the radio device 42 may be a remote radio head mounted on the raised structure 30 adjacent to the antenna. The baseband unit 40 can receive data from another source, such as a backhaul network (not shown), and process the data and provide a data stream to the radio device 42. The radio device 42 can generate RF signals including data encoded therein and can amplify and transmit these RF signals to the antenna 20 for transmission through a cable connection 44. It should also be understood that the base station 10 of FIG. 1 may generally include various other devices (not shown), such as a power supply, a backup battery, a power bus, an antenna interface signal group (AISG) controller, and the like.

Generally, a base station antenna includes one or more phase arrays of radiating elements, where when the antenna is mounted and used, the radiating elements are arranged in one or more columns along a vertical direction ("columns" referred to in the present Specification all refer to columns oriented in the vertical direction unless otherwise specified). In the present Specification, "vertical" refers to a direction perpendicular to a plane defined by the horizon. The elements arranged, provided, or extended in the vertical direction in the antenna refer to the scenario that when the antenna is mounted on a support structure for operation and there is no physical angle of tilt, these elements are arranged, provided, or extended in a direction perpendicular to the plane defined by the horizon.

SUMMARY

According to a first aspect of the present disclosure, a base station antenna is provided, comprising: a column of radiating elements comprising a plurality of radiating elements that are arranged in a vertical direction, each radiating element being configured to operate in a first frequency band, the first frequency band comprising first and second sub-bands, the plurality of radiating elements comprising first and second sets of radiating elements, and each set of radiating elements comprising one or more radiating elements, wherein the second set of radiating elements is located above and/or below the first set of radiating elements, and a feeding assembly that is configured to feed first radio frequency signals that are in the first sub-band and second radio frequency signals that are in the second sub-band to the column of radiating elements, wherein the feeding assembly is configured to partially attenuate sub-components of the second radio frequency signals that are fed to the second set of radiating elements more than sub-components of the first radio frequency signals that are fed to the second set of radiating elements.

According to a second aspect of the present disclosure, a base station antenna is provided, comprising: a column of radiating elements comprising a plurality of radiating elements that are configured to operate in a first frequency band that are arranged in a vertical direction, the first frequency band comprising first and second sub-bands, the plurality of radiating elements comprising first and second sets of radiating elements, and each set of radiating elements comprising one or more radiating elements, wherein the second set of radiating elements is located above and/or below the first set of radiating elements; and a feeding assembly configured to receive a combined signal comprising a signal within the first sub-band and a signal within the second sub-band, feed a first portion of the combined signal to the first set of radiating elements, and feed a second portion of the combined signal to the second set of radiating elements, wherein the first portion comprises a first sub-component of the signal within the first sub-band and a first sub-component of the signal within the second sub-band, and the second portion comprises a second sub-component of the signal within the first sub-band and a second sub-component of the signal within the second sub-band, wherein the feeding assembly is configured to attenuate the second sub-component of the signal within the second sub-band more than the second sub-component of the signal within the first sub-band.

According to a third aspect of the present disclosure, a base station antenna is provided, comprising: a linear array of radiating elements, configured to operate in a first frequency band and a second frequency band, comprising a plurality of radiating elements that are arranged in a vertical direction, and the plurality of radiating elements comprising a first subset of radiating elements that is closer to a middle of the linear array and a second subset of radiating elements that is closer to an end of the linear array; and a feeding assembly configured to feed a first sub-component of a signal within the first frequency band and a first sub-component of a signal within the second frequency band to the first subset, and feed a second sub-component of the signal within the first frequency band and a second sub-component of the signal within the second frequency band to the second subset, wherein the feeding assembly is configured to attenuate the second sub-component of the signal within the second frequency band more than the second sub-component of the signal within the first frequency band.

Figure 1:
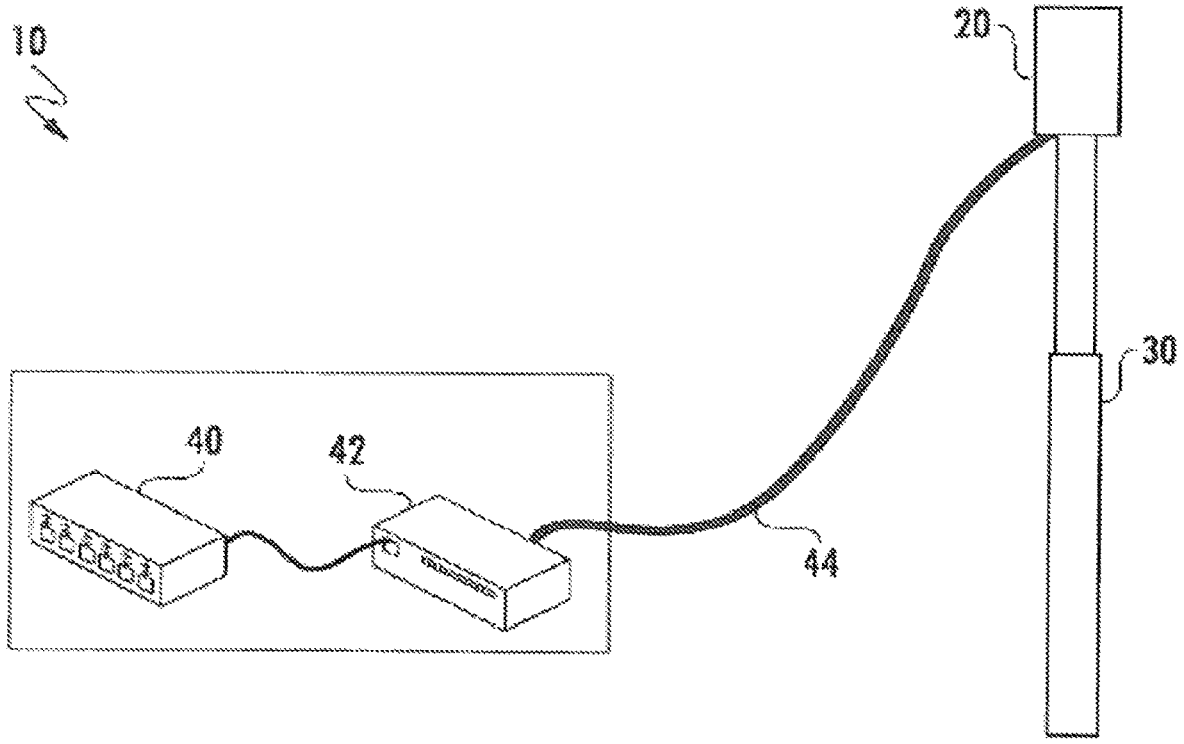
FIG. 1 is a simplified schematic diagram of a conventional base station in a cellular communication system.

Note, in the embodiments described below, the same signs are sometimes jointly used between different attached drawings to denote the same parts or parts with the same functions, and repeated descriptions thereof are omitted. In some cases, similar labels and letters are used to indicate similar items. Therefore, once an item is defined in one attached drawing, it does not need to be further discussed in subsequent attached drawings.

For ease of understanding, the position, dimension, and range of each structure shown in the attached drawings and the like may not indicate the actual position, dimension, and range. Therefore, the present disclosure is not limited to the positions, dimensions, and ranges disclosed in the attached drawings and the like.

DETAILED DESCRIPTION

The present disclosure will be described below with reference to the attached drawings, wherein the attached drawings illustrate certain embodiments of the present disclosure. However, it should be understood that the present disclosure may be presented in many different ways and is not limited to the embodiments described below; in fact, the embodiments described below are intended to make the disclosure of the present disclosure more complete and to fully explain the protection scope of the present disclosure to those of ordinary skill in the art. It should also be understood that the embodiments disclosed in the present disclosure may be combined in various ways so as to provide more additional embodiments.

It should be understood that the terms used herein are only used to describe specific examples, and are not intended to limit the scope of the present disclosure. All terms used herein (including technical terms and scientific terms) have meanings normally understood by those skilled in the art unless otherwise defined. For brevity and/or clarity, well-known functions or structures may not be further described in detail.

As used herein, when an element is said to be "on" another element, "attached" to another element, "connected" to another element, "coupled" to another element, or "in contact with" another element, etc., the element may be directly on another element, attached to another element, connected to another element, coupled to another element, or in contact with another element, or an intermediate element may be present. In contrast, if an element is described "directly" "on" another element, "directly attached" to another element, "directly connected" to another element, "directly coupled" to another element or "directly in contact with" another element, there will be no intermediate elements. As used herein, when one feature is arranged "adjacent" to another feature, it may mean that one feature has a part overlapping with the adjacent feature or a part located above or below the adjacent feature.

In this specification, elements, nodes or features that are "coupled" together may be mentioned. Unless explicitly stated otherwise, "coupled" means that one element/node/feature can be mechanically, electrically, logically or otherwise connected with another element/node/feature in a direct or indirect manner to allow interaction, even though the two features may not be directly connected. That is, "coupled" is intended to comprise direct and indirect connection of components or other features, including connection using one or a plurality of intermediate components.

As used herein, spatial relationship terms such as "upper", "lower", "left", "right", "front", "back", "high" and "low" can explain the relationship between one feature and another in the drawings. It should be understood that, in addition to the orientations shown in the attached drawings, the terms expressing spatial relations also comprise different orientations of a device in use or operation. For example, when a device in the attached drawings rotates reversely, the features originally described as being "below" other features now can be described as being "above" the other features". The device may also be oriented by other means (rotated by 90 degrees or at other locations), and at this time, a relative spatial relation will be explained accordingly.

As used herein, the term "A or B" comprises "A and B" and "A or B", not exclusively "A" or "B", unless otherwise specified.

As used herein, the term "exemplary" means "serving as an example, instance or explanation", not as a "model" to be accurately copied". Any realization method described exemplarily herein may not be necessarily interpreted as being preferable or advantageous over other realization methods. Furthermore, the present disclosure is not limited by any expressed or implied theory given in the above technical field, background art, summary of the invention or embodiments.

As used herein, the word "basically" means including any minor changes caused by design or manufacturing defects, device or component tolerances, environmental influences, and/or other factors. The word "basically" also allows the gap from the perfect or ideal situation due to parasitic effects, noise, and other practical considerations that may be present in the actual realization.

In addition, for reference purposes only, "first", "second" and similar terms may also be used herein, and thus are not intended to be limitative. For example, unless the context clearly indicates, the words "first", "second" and other such numerical words involving structures or elements do not imply a sequence or order.

It should also be understood that when the term "comprise/include" is used herein, it indicates the presence of the specified feature, entirety, step, operation, unit and/or component, but does not exclude the presence or addition of one or a plurality of other features, steps, operations, units and/or components and/or combinations thereof.

According to an embodiment of the present disclosure, a base station antenna supporting communication in a plurality of frequency bands is provided. The base station antenna may include a linear array that includes a plurality of radiating elements arranged in a vertical direction, and each radiating element may be a wideband radiating element. The wideband radiating element may transmit and receive signals in first and second frequency bands, where the first frequency band is different from the second frequency band. Each wideband radiating element may include a first radiator configured to transmit and receive signals in the first frequency band, and a second radiator configured to transmit and receive signals in the second frequency band. In an embodiment, the second radiator may be parasitic to the first radiator.

The first and second frequency bands may be widely separated from each other, for example, may be a 2.3 to 2.69 GHz band and a 3.3 to 3.8 GHz band, respectively. It should be understood that the present disclosure is not limited thereto. The first and second frequency bands may also be other frequency bands supported by the wideband radiating element. For example, they may respectively be a 3.4 to 4.2 GHz band and a 5.15 to 5.925 GHz band, a 1.7 to 1.9 GHz band and a 2.5 to 2.7 GHz band, or a 690 to 960 MHz band and a 1.71 to 2.7 GHz band, etc.

The radiating element in the linear array included in the base station antenna according to the embodiment of the present disclosure may be configurably divided into two different sets. A first set of radiating elements includes one or more radiating elements in the linear array, and a second set of radiating elements includes one or more of the remaining radiating elements in the linear array other than the first set of radiating elements. The first set of radiating elements may be closer to a middle of the linear array, and the second set of radiating elements may be closer to an end of the linear array, for example, above and/or below the first set of radiating elements. The feeding assembly feeds first radio frequency signals that are in a first sub-band and second radio frequency signals that are in a second sub-band to the linear array. The feeding assembly partially attenuates sub-components of the second radio frequency signals that are fed to the second set of radiating elements more than sub-components of the first radio frequency signals that are fed to the second set of radiating elements. For example, the feeding assembly reduces a magnitude of the sub-components of the second radio frequency signals that are fed to the second set of radiating elements by a first amount and reduces a magnitude of the sub-components of the first radio frequency signals that are fed to the second set of radiating elements by a second amount, where the first amount is at least 30% more than the second amount. Here, the feeding assembly may not attenuate or may partially attenuate the sub-components of the first radio frequency signals that are fed to the second set of radiating elements. The attenuation referred to in the Specification includes filtering out the sub-components of the signals by a filter and attenuating the sub-components of the signals by an attenuator. For example, in the case where no other elements in the base station antenna attenuate the sub-components of the radio frequency signals, the sub-components of the second radio frequency signal fed to the second set of radiating elements are weaker than the sub-components of the first radio frequency signal fed to the second set of radiating elements. In this way, the antenna beams of the linear array in the second frequency band can be broadened and the gain of the linear array in the second frequency band can be reduced. In an example of the aforementioned situation, the magnitude of the sub-components of the second radio frequency signals that are fed to the second set of radiating elements is at least 30% less than the magnitude of the sub-components of the first radio frequency signals that are fed to the second set of radiating elements. In another example of the aforementioned situation, the ratio of the magnitude of the sub-components of the second radio frequency signals that are fed to the second set of radiating elements to the magnitude of the sub-components of the first radio frequency signals that are fed to the second set of radiating elements is in the range of 0.04 to 0.7.

Exemplary embodiments of the present disclosure will now be discussed in more detail with reference to the attached drawings.

Figure 3:
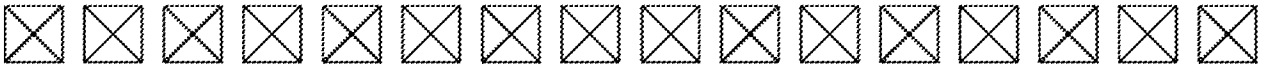
FIG. 3 is a schematic diagram of a linear array in a base station antenna in the prior art.
Figure 5A:
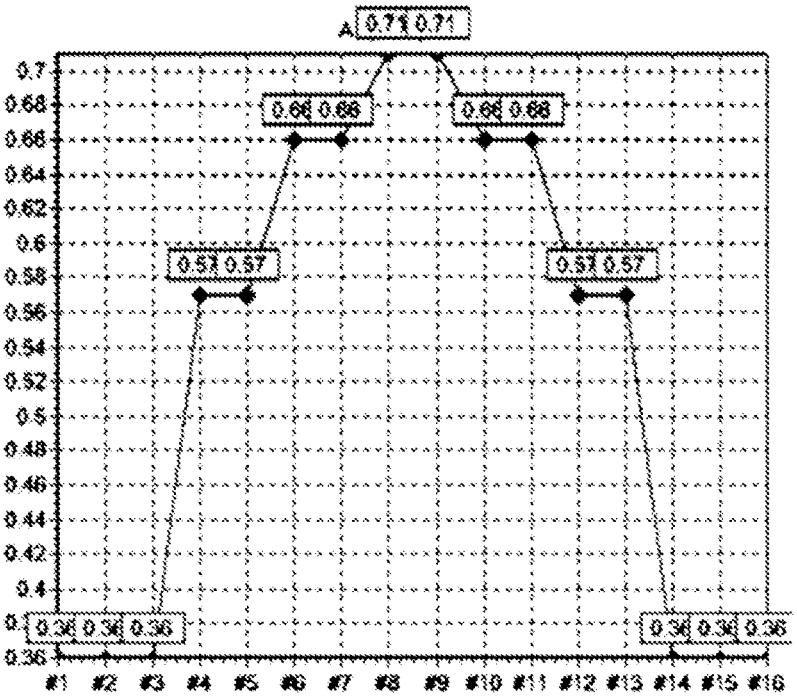
FIG. 5A is an amplitude of a 2.5 GHz radio frequency signal fed to the linear array shown in FIG. 3 in a simulation experiment.
Figure 5B:
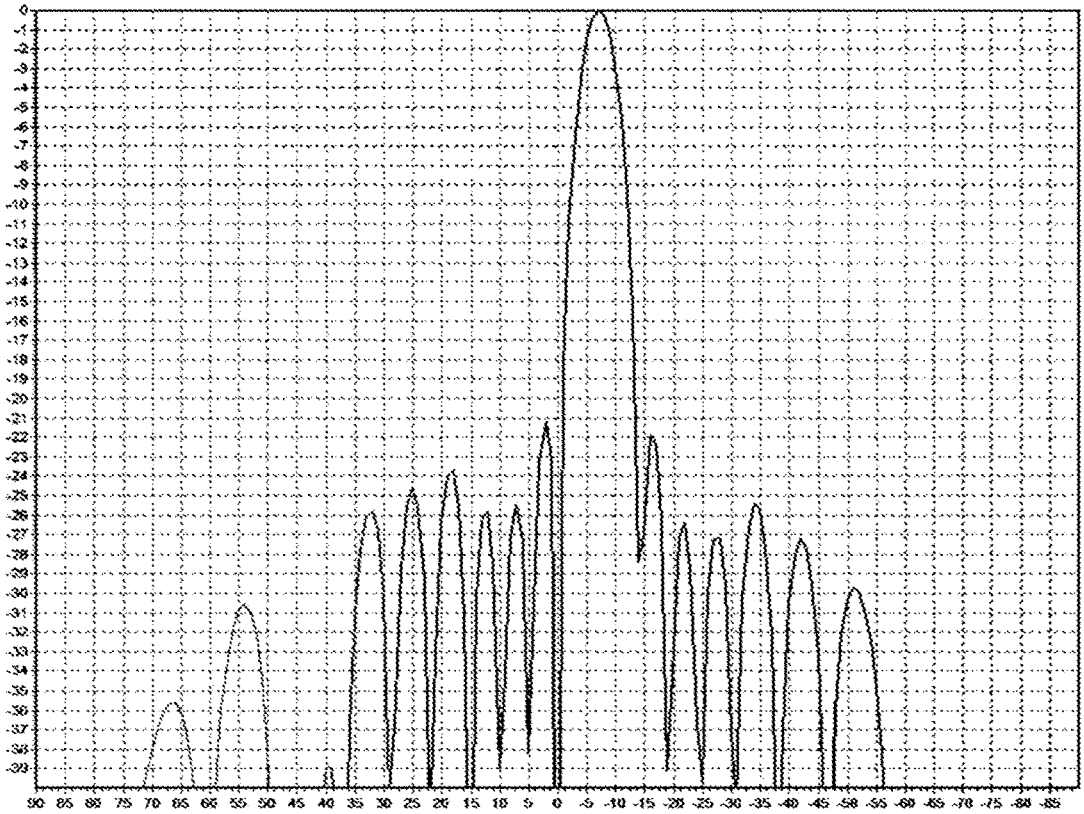
FIG. 5B is a schematic diagram of an intensity of electromagnetic radiation generated by the linear array changing with a pitch angle in the simulation experiment shown in FIG. 5A.
Figure 5C:
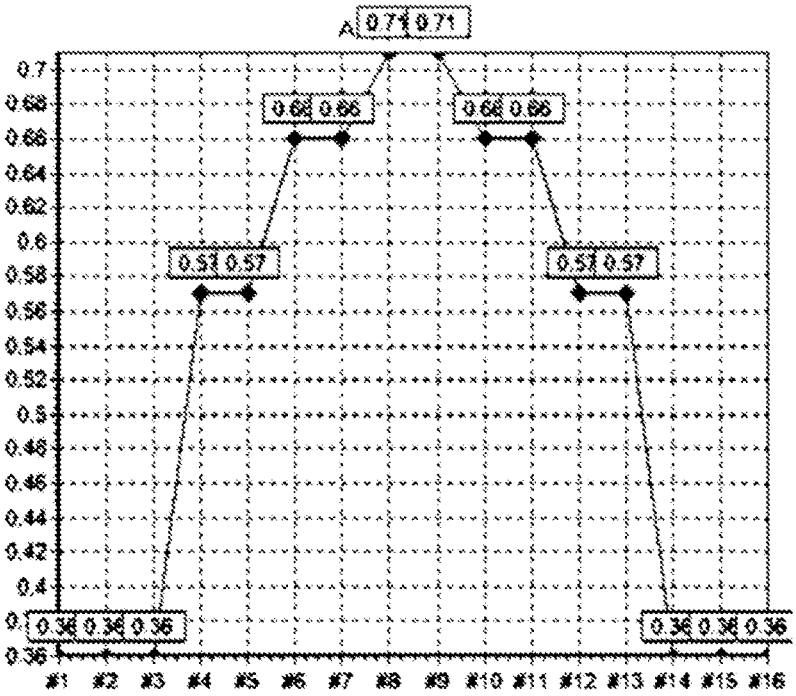
FIG. 5C is an amplitude of a 3.5 GHz radio frequency signal fed to the linear array shown in FIG. 3 in a simulation experiment.
Figure 5D:
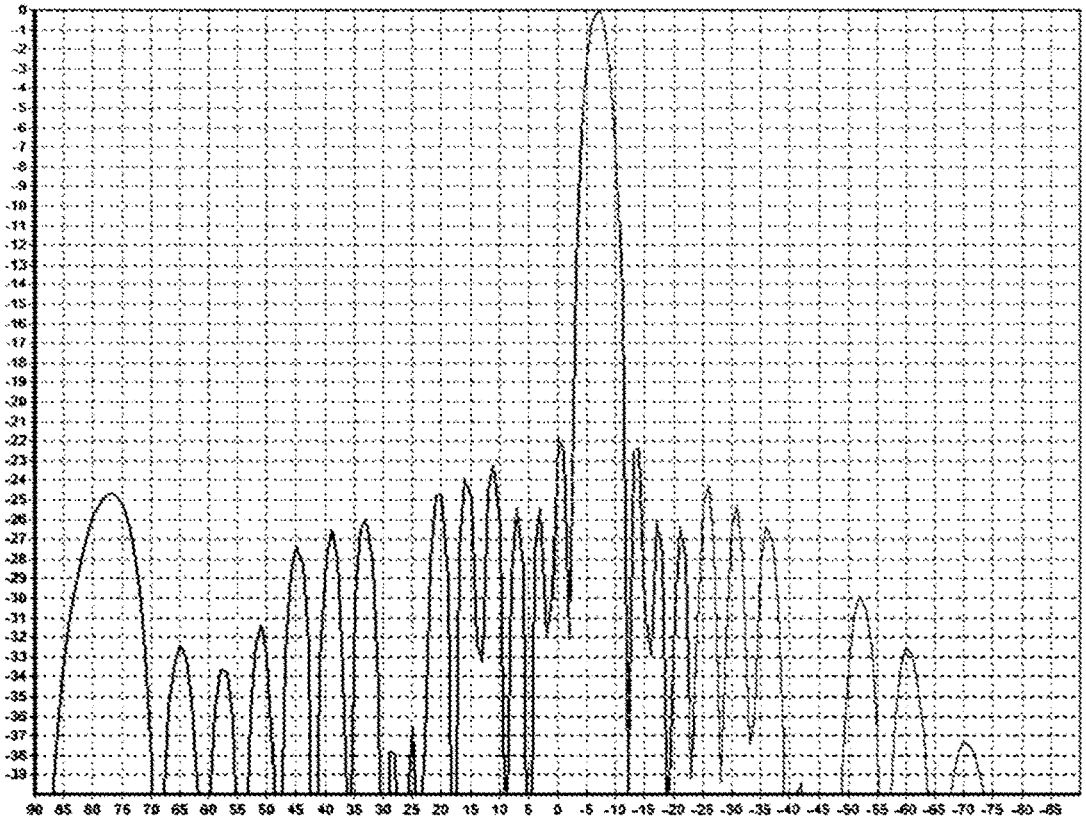
FIG. 5D is a schematic diagram of an intensity of electromagnetic radiation generated by the linear array changing with a pitch angle in the simulation experiment shown in FIG. 5C.

FIG. 3 is a schematic diagram schematically showing a linear array in a base station antenna known in the prior art. The linear array includes 16 radiating elements arranged in a vertical direction, and each radiating element can transmit and receive signals in the first and second frequency bands. The first frequency band may be a 2.3 to 2.69 GHz band, and the second frequency band may be a 3.3 to 3.8 GHz band. FIGS. 5A and 5C are respectively amplitudes of a 2.5 GHz radio frequency signal in the first frequency band and a 3.5 GHz radio frequency signal in the second frequency band fed to the linear array shown in FIG. 3 in a simulation experiment, and FIGS. 5B and 5D are schematic diagrams of intensities of electromagnetic radiation generated by the linear array changing with pitch angles in the simulation experiment. In FIGS. 5A and 5C, the radiating elements in the linear array shown in FIG. 3 are sequentially indicated as #1 radiating element to #16 radiating element from top to bottom. In the simulation experiment, for any radiating element, the amplitudes of the signal in the first frequency band and the signal in the second frequency band fed to the radiating element are substantially the same. For example, the amplitudes of signals fed to #1 to #3 and #14 to #16 radiating elements at the aforementioned two frequencies are all 0.36 volts, the amplitudes of signals fed to #4, #5, #12, and #13 radiating elements at the two frequencies are all 0.57 volts, the amplitudes of signals fed to #6, #7, #10, and #11 radiating elements at the two frequencies are all 0.66 volts, and the amplitudes of signals fed to #8 and #9 radiating elements at the two frequencies are both 0.71 volts. The antenna beams generated by the linear array all have a downtilt angle of about 7 degrees at the two frequencies. The antenna beam has a −3 dB beam width in an elevation plane of approximately 5.8 degrees and 4.12 degrees and a directivity of approximately 12.76 dB and 14.17 dB respectively at the two frequencies.

In some applications, the beam width of approximately 4.12 degrees (unless otherwise specified, the beam width in the Specification refers to the −3 dB beam width in the elevation plane) may be smaller than a required beam width.

Figure 4A:
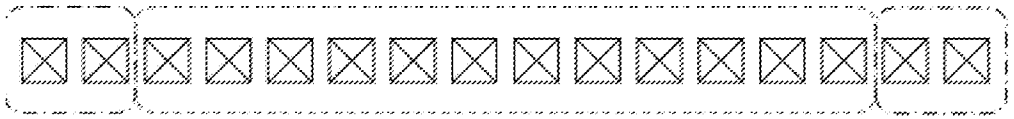
FIGS. 4A to 4E are schematic diagrams of configurations of first and second sets of radiating elements in a linear array in a base station antenna according to some embodiments of the present disclosure.
Figure 4B:
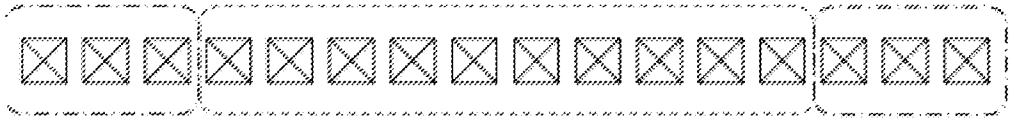
Figure 4C:
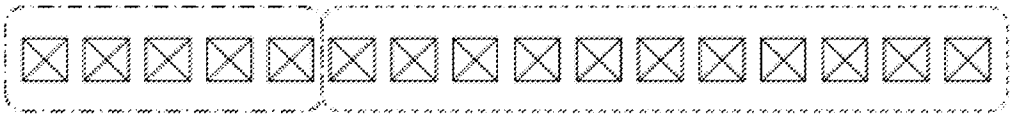
Figure 4D:
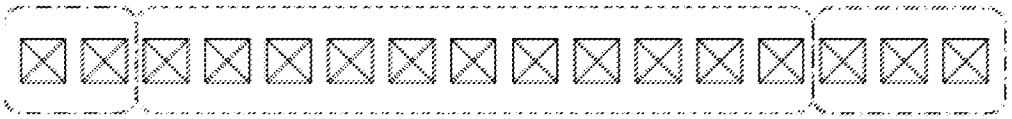
Figure 4E:
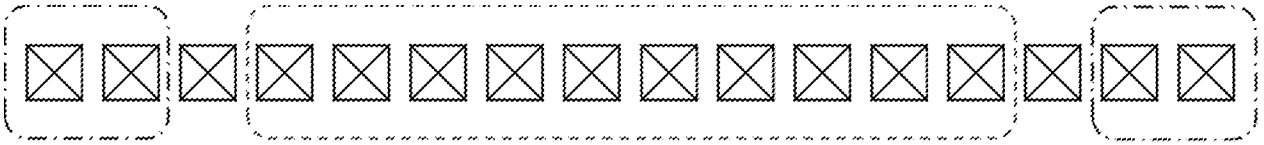
Figure 5E:
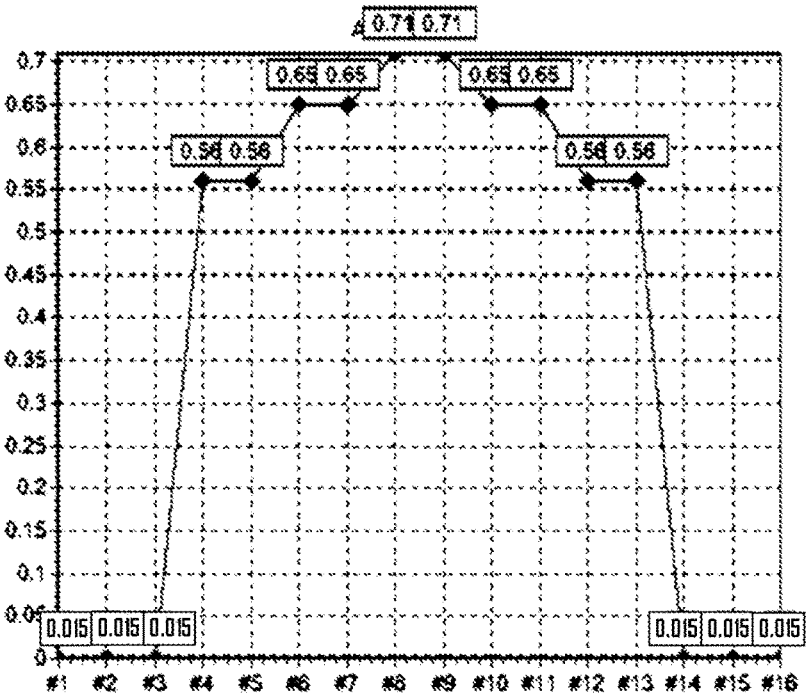
FIG. 5E is an amplitude of a 3.5 GHz radio frequency signal fed to the linear array shown in FIG. 4B in a simulation experiment.
Figure 5F:
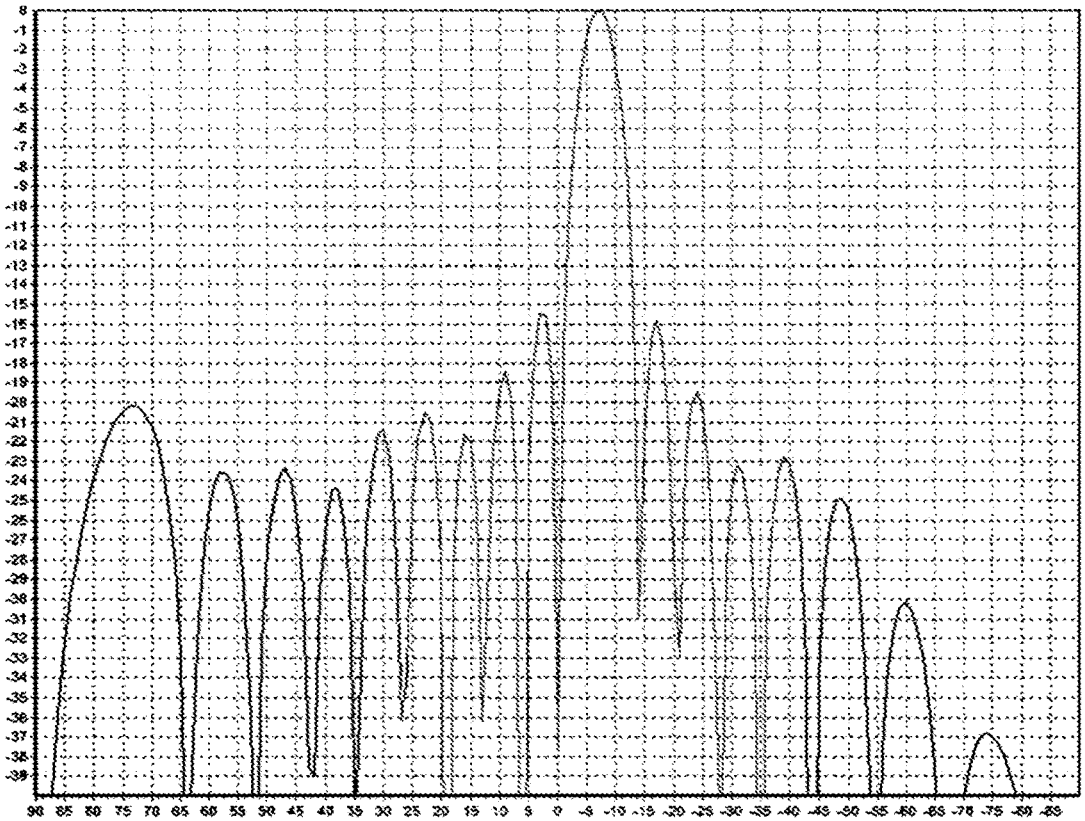
FIG. 5F is a schematic diagram of an intensity of electromagnetic radiation generated by the linear array changing with a pitch angle in the simulation experiment shown in FIG. 5E.

FIGS. 4A to 4E are schematic diagrams schematically showing configurations of first and second sets of radiating elements in a linear array in a base station antenna according to some embodiments of the present disclosure, where the first set of radiating elements is framed by dashed lines and the second set of radiating elements are framed by dotted lines. In the embodiments shown in FIGS. 4A and 4B, the second set of radiating elements are symmetrically arranged above and below the first set of radiating elements. The number of radiating elements in the second set of radiating elements may be determined according to needs. The more radiating elements in the second set of radiating elements, the wider the antenna beam in the second frequency band. FIG. 5E is an amplitude of a 3.5 GHz radio frequency signal in the second frequency band fed to the linear array shown in FIG. 4B in a simulation experiment, and FIG. 5F is a schematic diagram of an intensity of electromagnetic radiation generated by the linear array changing with a pitch angle in the simulation experiment. Comparing the simulation experiment with the 2.5 GHz simulation experiment shown in FIG. 5A, for any radiating element in the first set of radiating elements, the amplitudes of the signal in the first frequency band and the signal in the second frequency band fed to the radiating element are substantially the same. For example, the amplitudes of signals fed to #4, #5, #12, and #13 radiating elements at the two frequencies are all 0.56 or 0.57 volts, the amplitudes of signals fed to #6, #7, #10, and #11 radiating elements at the two frequencies are all 0.65 or 0.66 volts, and the amplitudes of signals fed to #8 and #9 radiating elements at the two frequencies are both 0.71 volts. For any radiating element in the second set of radiating elements, the amplitude of the signal in the second frequency band fed to the radiating elements is smaller than the amplitude of the signal in the first frequency band fed to the radiating element. For example, the amplitudes of signals fed to #1 to #3 and #14 to #16 radiating elements at 2.5 GHz frequency are 0.36 volts, and the amplitudes of signals fed at 3.5 GHz frequency are significantly reduced to 0.015 volts. As shown in FIG. 5F, in the simulation experiment shown in FIG. 5E, the antenna beams generated by the linear array have a downtilt angle of about 7.07 degrees. The beam width is approximately 6.06 degrees and the directivity is approximately 12.37 dB. It can be seen that comparing with the simulation result of FIG. 5D, the beam width in the second frequency band of the antenna beam of the linear array in the simulation experiment has increased from approximately 4.12 degrees to approximately 6.06 degrees, and is relatively close to the beam width in the first frequency band, which is approximately 5.8 degrees, in the simulation result of FIG. 5B.

In some embodiments, the second set of radiating elements may not be arranged symmetrically above and below the first set of radiating elements. In an embodiment, as shown in FIG. 4C, the second set of radiating elements may be arranged only above or below the first set of radiating elements. In an embodiment, as shown in FIG. 4D, the number of the second set of radiating elements located above the first set of radiating elements and the number of the second set of radiating elements located below the first set of radiating elements may be different.

Figure 5G:
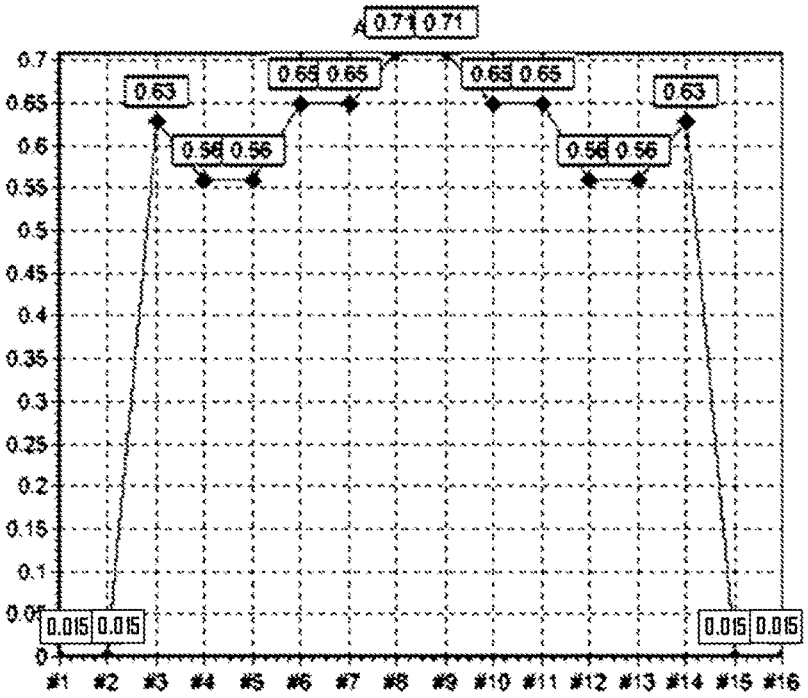
FIG. 5G is an amplitude of a 3.5 GHz radio frequency signal fed to the linear array shown in FIG. 4E in a simulation experiment.
Figure 5H:
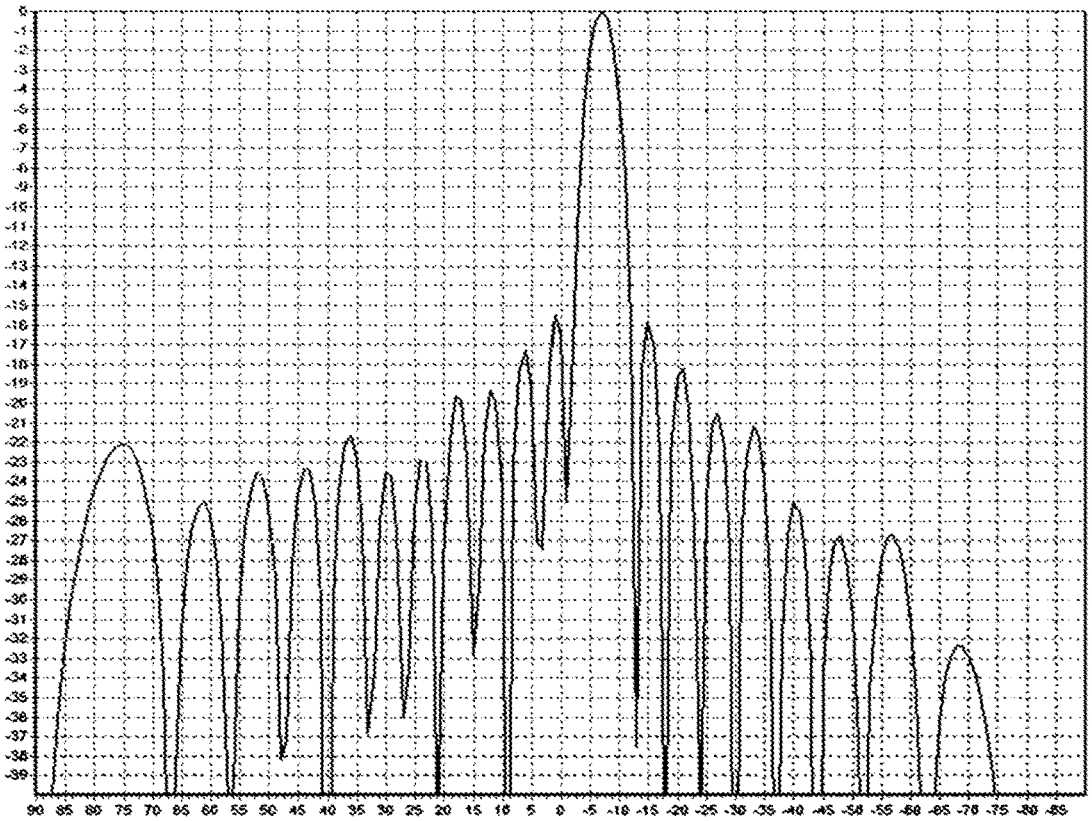
FIG. 5H is a schematic diagram of an intensity of electromagnetic radiation generated by the linear array changing with a pitch angle in the simulation experiment shown in FIG. 5G.

In some embodiments, the linear array may further include radiating elements other than the first set of radiating elements and the second set of radiating elements. In an embodiment, as shown in FIG. 4E, the linear array includes a first set of radiating elements located in the middle, a second set of radiating elements located at an upper end and/or a lower end, and a third set of radiating elements (not framed by dashed lines or dotted lines in the figure) between the first set and second set of radiating elements. Here, the amplitude of signals fed to the third set of radiating elements in the two frequency bands may be determined according to needs. FIG. 5G is an amplitude of a 3.5 GHz radio frequency signal in the second frequency band fed to the linear array shown in FIG. 4E in a simulation experiment, and FIG. 5H is a schematic diagram of an intensity of electromagnetic radiation generated by the linear array changing with a pitch angle in the simulation experiment. Comparing the simulation experiment with the 2.5 GHz simulation experiment shown in FIG. 5A, for any radiating element in the first set of radiating elements, the amplitudes of the signal in the first frequency band and the signal in the second frequency band fed to the radiating element are substantially the same. For example, the amplitudes of signals fed to #4, #5, #12, and #13 radiating elements at the two frequencies are all 0.56 or 0.57 volts, the amplitudes of signals fed to #6, #7, #10, and #11 radiating elements at the two frequencies are all 0.65 or 0.66 volts, and the amplitudes of signals fed to #8 and #9 radiating elements at the two frequencies are both 0.71 volts. For any radiating element in the second set of radiating elements, the amplitude of the signal in the second frequency band fed to the radiating elements is smaller than the amplitude of the signal in the first frequency band fed to the radiating element. For example, the amplitudes of signals fed to #1, #2, #15, and #16 radiating elements at 2.5 GHz frequency are 0.36 volts, and the amplitudes of signals fed at 3.5 GHz frequency are significantly reduced to 0.015 volts. For any radiating element in the third set of radiating elements, the amplitude of the signal in the second frequency band fed to the radiating elements in the simulation experiment is larger than the amplitude of the signal in the first frequency band fed to the radiating element. For example, the amplitudes of signals fed to #3 and #14 radiating elements at 2.5 GHz frequency are 0.36 volts, and the amplitudes of signals fed at 3.5 GHz frequency are significantly increased to 0.63 volts. As shown in FIG. 5H, in the simulation experiment shown in FIG. 5G, the antenna beams generated by the linear array have a downtilt angle of about 7.09 degrees. The beam width is approximately 4.86 degrees and the directivity is approximately 13.17 dB. It can be seen that comparing with the simulation result of FIG. 5D, the beam width in the second frequency band of the antenna beam of the linear array in the simulation experiment has increased from approximately 4.12 degrees to approximately 4.86 degrees, which has been widened.

It should be understood that the first and second sets of radiating elements are not limited to the configurations shown in FIGS. 4A to 4E. Without departing from the gist of the present disclosure, those skilled in the art can configure which radiating elements in the linear array belong to the first set of radiating elements and which belong to the second set of radiating elements according to needs.

Figure 2:
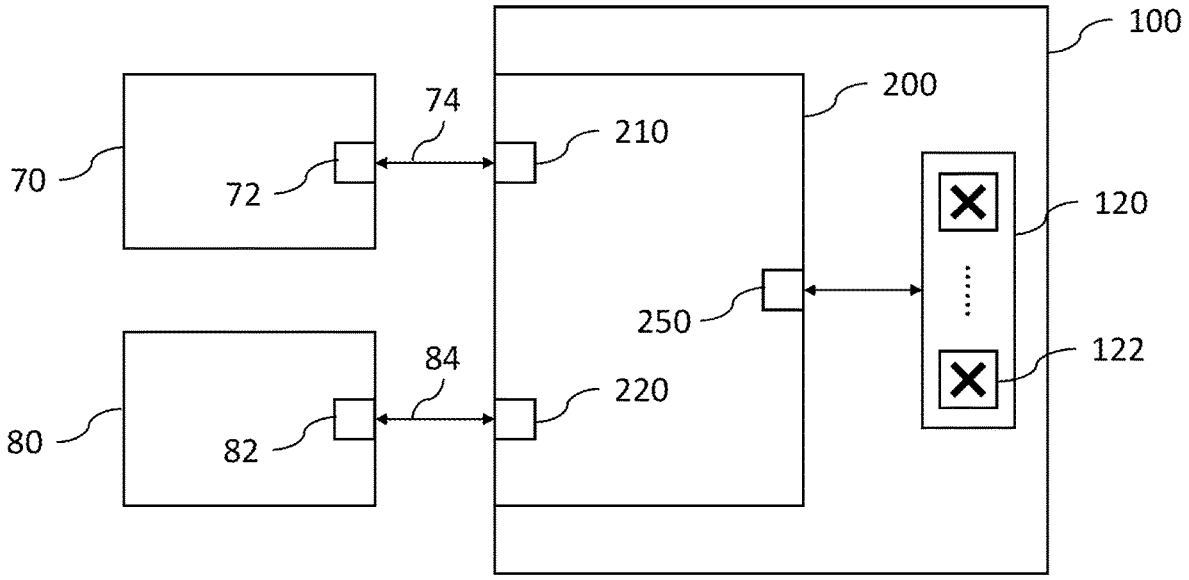
FIG. 2 is a schematic block diagram of a base station antenna and its connection with a radio device according to an embodiment of the present disclosure.

FIG. 2 is a schematic block diagram schematically showing a base station antenna 100 and its connection with radio devices 70 and 80 according to an embodiment of the present disclosure. As shown in FIG. 2, the base station antenna 100 includes a linear array 120 and a feeding network 200. The linear array 120 includes a plurality of radiating elements 122 arranged in a vertical direction. Any suitable radiating element 122, including, for example, a dipole, cross dipole, and/or patch radiating element, may be used. All the radiating elements 122 may be the same. The feeding network 200 is used to feed the linear array 120.

In addition, the base station antenna 100 may further include other conventional components not shown in FIG. 2, such as a radome, an RF lens for the radiating element 122, a reflector assembly, and a plurality of circuit elements and other structures mounted therein. These circuit elements and other structures may include, for example, a phase shifter for one or more linear arrays, a remote electrical tilt (RET) actuator for mechanical adjustment of the phase shifter, one or more controllers, cable connections, RF transmission lines, etc. A mounting bracket (not shown) may also be provided for mounting the base station antenna 100 to another structure, for example, an antenna tower or a telegraph pole.

The feeding network 200 may be fed by a first radio device 70 operating in a first frequency band and a second radio device 80 operating in a second frequency band. For example, in one application, the first radio device 70 is a 2.5 GHz radio device, and the second radio device 80 is a 3.5 GHz radio device. The first radio device 70 has a port 72, and the second radio device 80 has a port 82. The ports 72 and 82 of the radio devices 70 and 80 pass transmitted and received RF signals because duplexing of transmission and reception channels is performed inside the radio devices 70 and 80.

The feeding network 200 may have two inputs 210 and 220. The input 210 may be connected to the wireless port 72 through a coaxial cable 74, for example, to receive signals in the first frequency band, and the input 220 may be connected to the wireless port 82 through a coaxial cable 84, for example, to receive signals in the second frequency band. The feeding network 200 may include an output 250, which is coupled to the linear array 120 and is configured to output a combined signal including a signal within the first frequency band and a signal within the second frequency band. The feeding network 200 may include a power coupler (for example, a combiner, a bidirectional coupler, etc.) to combine the signals within the first and second frequency bands respectively received by the two inputs 210 and 220 to generate a combined signal. It should be noted that the ports 210 and 220 are referred to as "inputs" and the port 250 is referred to as "output" to describe a situation when the base station antenna 100 transmits RF signals. It should be understood that when the base station antenna 100 receives RF signals, the port 250 will operate as an "input" and the ports 210 and 220 will operate as "outputs" due to the reversal of the traveling direction of the RF signals. In addition, the term "combiner" is also referred to for the situation where the base station antenna 100 transmits RF signals. It should be understood that when the base station antenna 100 receives RF signals, the aforementioned combiner may operate as a splitter.

Although the feeding network 200 shown in FIG. 2 has an input 210 connected to the first radio device 70, an input 220 connected to the second radio device 80, and an output 250 coupled to the linear array 120, it should be understood that FIG. 2 is only schematic. When the radiating element 122 is a dual-polarized radiating element, the feeding network 200 may include two inputs 210 connected to the first radio device 70, and the first radio device 70 may include two corresponding wireless ports 72 to provide the feeding network 200 with signals in the first frequency band having a first polarization and a second polarization. Similarly, the feeding network 200 may include two inputs 220 connected to the second radio device 80, and the second radio device 80 may include two corresponding wireless ports 82 to provide the feeding network 200 with signals in the second frequency band having a first polarization and a second polarization. Correspondingly, the feeding network 200 may include two outputs 250 to provide each radiating element 122 in the linear array 120 with a combined signal having a first polarization and a combined signal having a second polarization.

Figure 6A:
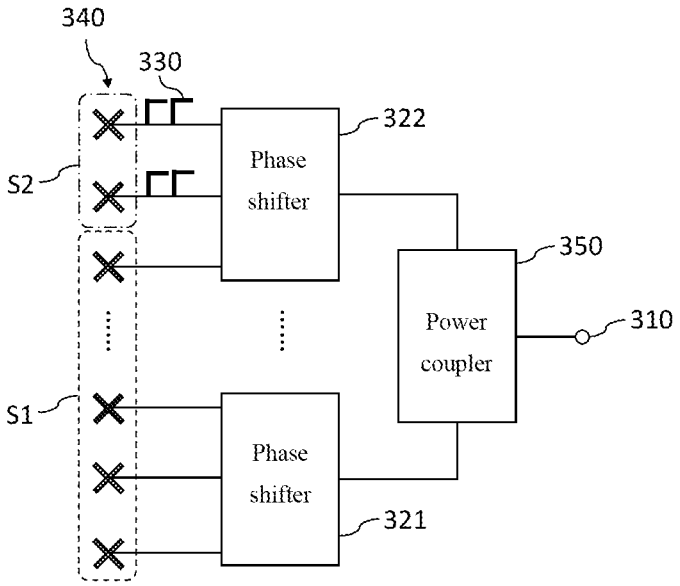
FIGS. 6A and 6B are schematic diagrams of feeding a linear array by a feeding assembly in a base station antenna according to some embodiments of the present disclosure.
Figure 6B:
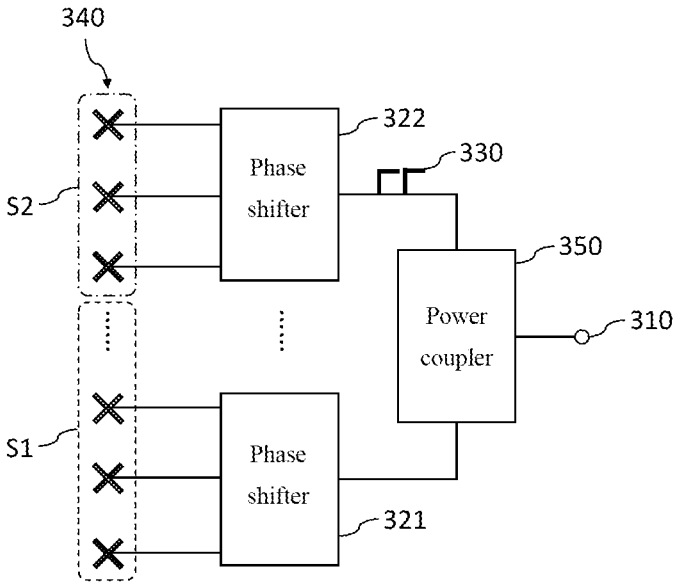

FIGS. 6A and 6B show feeding assemblies in a feeding network according to some embodiments of the present disclosure. In the embodiment shown in FIG. 6A, a port 310 of the feeding assembly receives a combined signal including a signal within a first sub-band and a signal within a second sub-band. A power coupler 350 (for example, a power divider) may divide the combined signal into a plurality of portions to be respectively passed to a plurality of phase shifters. In the embodiment, a first portion of the combined signal is passed to a phase shifter 321, and a plurality of signals output by the phase shifter 321 are respectively fed to a plurality of radiating elements in a first set of radiating elements S1 in a linear array 340. A second portion of the combined signal is passed to a phase shifter 322. Among a plurality of signals output by the phase shifter 322, some are fed to the radiating elements in the first set of radiating elements S1, and some are fed to radiating elements in a second set of radiating elements S2. A filter 330 is provided on a path for feeding the second set of radiating elements (that is, a feeding path for the second set of radiating elements), for example, coupled between an output of the phase shifter 322 and the second set of radiating elements fed by the output. However, no filter 330 is provided between an output of the phase shifter 322 and the first set of radiating elements fed by the output. The filter 330 is configured to partially filter out (or partially attenuate) sub-components of signals within the second sub-band, for example, to reduce the intensity of the signals within the second sub-band by 3 dB to 28 dB. In an embodiment, the filter 330 may also be replaced with an attenuator, which is configured to partially attenuate the sub-components of the signals within the second sub-band. In this way, comparing with the sub-components of the signals within the first sub-band fed to the second set of radiating elements, the feeding assembly can attenuate the sub-components of the signals within the second sub-band fed to the second set of radiating elements more. Moreover, comparing with the sub-components of the signals within the first sub-band fed to the first set of radiating elements, the feeding assembly does not attenuate the sub-components of the signals within the second sub-band fed to the first set of radiating elements more.

In the embodiment shown in FIG. 6B, the port 310 of the feeding assembly receives a combined signal including a signal in the first sub-band and a signal in the second sub-band. The power coupler 350 (for example, a power divider) may divide the combined signal into a first portion and a second portion. The first portion includes a first sub-component of the signal within the first sub-band and a first sub-component of the signal within the second sub-band, which will be fed to the first set of radiating elements S1 in the linear array 340. The second portion includes a second sub-component of the signal within the first sub-band and a second sub-component of the signal within the second sub-band, which will be fed to the second set of radiating elements S2 in the linear array 340. The power coupler 350 outputs the first portion of the combined signal to a phase shifter for the first set of radiating elements S1, for example, the phase shifter 321, for phase control. The signals output by these phase shifters are respectively fed to the radiating elements in the first set of radiating elements S1. The power coupler 350 outputs the second portion of the combined signal to the phase shifter 322, and the signals output by the phase shifter 322 are respectively fed to the radiating elements in the second set of radiating elements S2. The filter 330 may be coupled between an output of the power coupler 350 and an input of the phase shifter 322. In this way, comparing with the sub-components of the signals within the first sub-band fed to the second set of radiating elements, the feeding assembly can attenuate the sub-components of the signals within the second sub-band fed to the second set of radiating elements more. Moreover, comparing with the sub-components of the signals within the first sub-band fed to the first set of radiating elements, the feeding assembly does not attenuate the sub-components of the signals within the second sub-band fed to the first set of radiating elements more.

It should be understood that the aforementioned filter may have any known structure, such as a microstrip filter, a stripline filter, and a cavity filter.

It should be understood that the base station antenna according to the present disclosure may include one or more of the aforementioned linear arrays, and/or may include other known radiating element arrays. It should be noted that the linear array in the base station antenna of the embodiment of the present disclosure does not limit the arrangement of a plurality of radiating elements in a straight line. The plurality of radiating elements arranged vertically in a column may be arranged staggered, for example, arranged with a slight offset along a horizontal or vertical axis. The reflector assembly of the base station antenna according to the embodiment of the present disclosure may be flat, V-shaped and variations thereof, or cylindrical, etc., and one or more of the aforementioned linear arrays may be positioned on the reflector assembly in any known radiation pattern.

Although some specific embodiments of the present disclosure have been described in detail through examples, those skilled in the art should understand that the above examples are only for illustration rather than for limiting the scope of the present disclosure. The embodiments disclosed herein can be combined arbitrarily without departing from the spirit and scope of the present disclosure. Those skilled in the art should also understand that various modifications can be made to the embodiments without departing from the scope and spirit of the present disclosure. The scope of the present disclosure is defined by the attached claims.

That which is claimed is:

1. A base station antenna, comprising:

a column of radiating elements comprising a plurality of radiating elements that are arranged in a vertical direction, each radiating element being configured to operate in a first frequency band, the first frequency band comprising first and second sub-bands, the plurality of radiating elements comprising first and second sets of radiating elements, and each set of radiating elements comprising one or more radiating elements, wherein the second set of radiating elements is located above and/or below the first set of radiating elements, and a feeding assembly that is configured to feed first radio frequency (RF) signals that are in the first sub-band and second RF signals that are in the second sub-band to the column of radiating elements, wherein the feeding assembly is configured to partially attenuate sub-components of the second RF signals that are fed to the second set of radiating elements more than sub-components of the first RF signals that are fed to the second set of radiating elements, wherein the feeding assembly is configured to reduce a magnitude of the sub-components of the second RF signals that are fed to the second set of radiating elements by a first amount and to reduce a magnitude of the sub-components of the first RF signals that are fed to the second set of radiating elements by a second amount, where the first amount is at least 30% more than the second amount.

2. The base station antenna according to claim 1, wherein the feeding assembly is not configured to attenuate the sub-components of the second RF signals that are fed to the first set of radiating elements more than the sub-components of the first RF signals that are fed to the first set of radiating elements.

3. The base station antenna according to claim 1, wherein a structure of a radiating element in the first set of radiating elements is the same as that of a radiating element in the second set of radiating elements.

4. The base station antenna according to claim 1, wherein a number of radiating elements in the first set of radiating elements is greater than a number of radiating elements in the second set of radiating elements.

5. The base station antenna according to claim 1, wherein the first sub-band is lower than the second sub-band.

6. A base station antenna, comprising:

a column of radiating elements comprising a plurality of radiating elements that are configured to operate in a first frequency band that are arranged in a vertical direction, the first frequency band comprising first and second sub-bands, the plurality of radiating elements comprising first and second sets of radiating elements, and each set of radiating elements comprising one or more radiating elements, wherein the second set of radiating elements is located above and/or below the first set of radiating elements; and a feeding assembly configured to receive a combined signal comprising a signal within the first sub-band and a signal within the second sub-band, feed a first portion of the combined signal to the first set of radiating elements, and feed a second portion of the combined signal to the second set of radiating elements, wherein the first portion comprises a first sub-component of the signal within the first sub-band and a first sub-component of the signal within the second sub-band, and the second portion comprises a second sub-component of the signal within the first sub-band and a second sub-component of the signal within the second sub-band, wherein the feeding assembly is configured to attenuate the second sub-component of the signal within the second sub-band more than the second sub-component of the signal within the first sub-band.

7. The base station antenna according to claim 6, wherein the feeding assembly comprises a filter on a feeding path for the second set of radiating elements, and the filter is configured to partially attenuate the second sub-component of the signal within the second sub-band.

8. The base station antenna according to claim 7, wherein the filter is further configured to reduce an intensity of the signal within the second sub-band by 3 dB to 28 dB.

9. The base station antenna according to claim 7, wherein the feeding assembly further comprises:

an input node configured to receive the combined signal;

a first phase shifter coupled between the input node and the first set of radiating elements; and a second phase shifter coupled between the input node and the second set of radiating elements, wherein the filter is coupled between the input node and the second phase shifter.

10. The base station antenna according to claim 7, wherein the feeding assembly further comprises a phase shifter, and the phase shifter comprises:

a signal input configured to receive the combined signal;

a first output coupled to the first set of radiating elements; and a second output coupled to the second set of radiating elements, wherein the filter is coupled between the second output and the second set of radiating elements.

11. The base station antenna according to claim 6, wherein the feeding assembly comprises an attenuator on a feeding path for the second set of radiating elements, and the attenuator is configured to partially attenuate the second sub-component of the signal within the second sub-band.

12. The base station antenna according to claim 6, wherein the feeding assembly is not configured to attenuate the first sub-component of the signal within the second sub-band more than the first sub-component of the signal within the first sub-band.

13. The base station antenna according to claim 6, wherein a structure of a radiating element in the first set of radiating elements is the same as that of a radiating element in the second set of radiating elements.

14. The base station antenna according to claim 6, wherein a number of radiating elements in the first set of radiating elements is greater than a number of radiating elements in the second set of radiating elements.

15. The base station antenna according to claim 6, wherein the first sub-band is lower than the second sub-band.

* * * * *